US005509503A

United States Patent [19]

Salmon

[11] Patent Number: 5,509,503

[45] Date of Patent: Apr. 23, 1996

[54] METHOD FOR REDUCING ROPE SWAY IN ELEVATORS

[75] Inventor: John K. Salmon, South Windsor, Conn.

[73] Assignee: Otis Elevator Company, Farmington, Conn.

[21] Appl. No.: 249,559

[22] Filed: May 26, 1994

[51] Int. Cl.[6] ..... B66B 11/08

[52] U.S. Cl. ..... 187/266; 187/404

[58] Field of Search ..... 187/266, 264, 187/256, 254, 411, 404, 414

[56] References Cited

U.S. PATENT DOCUMENTS

| | | | |
|---|---|---|---|
| 3,845,842 | 11/1974 | Johnson | 187/266 |
| 3,885,773 | 5/1975 | Dunkelberger | 254/190 R |
| 3,991,856 | 11/1976 | Shigeta et al. | 187/1 R |
| 4,117,908 | 10/1978 | Nara et al. | 187/20 |
| 4,269,380 | 5/1981 | Shima et al. | 248/74 R |
| 4,460,065 | 7/1984 | Saxer | 187/29 R |
| 4,664,229 | 5/1987 | Obst | 187/1 R |
| 4,716,989 | 1/1988 | Coleman et al. | 187/1 R |
| 5,025,893 | 6/1991 | Saito | 187/20 |
| 5,351,788 | 10/1994 | De Jong | 187/266 |

FOREIGN PATENT DOCUMENTS

| | | | |
|---|---|---|---|
| 2-106584 | 4/1990 | Japan | B66B 7/06 |
| 2-106585 | 4/1990 | Japan | B66B 7/06 |
| 2-106586 | 4/1990 | Japan | B66B 7/06 |
| 2-106587 | 4/1990 | Japan | B66B 7/06 |

*Primary Examiner*—Kenneth Noland

[57] ABSTRACT

A method for controlling rope sway in an elevator is provided. In the first step a car is provided for travel in a hoistway, wherein the hoistway includes a pair of opposed vertically extending walls between which the car travels. The car includes a center of gravity having an x coordinate and a y coordinate. In the second step, a counterweight is provided for traveling between the hoistway walls. The car and the counterweight are connected to one another by a plurality of ropes. In the third step, a first number of ropes are attached to the car a distance away from the x coordinate of the car. In the fourth step, a second number of ropes are attached to the car a distance away from the x coordinate, equal to the distance the first number of ropes are away from the x coordinate, on the opposite side of the x coordinate as the first number of ropes. The distance the ropes are attached away from the x coordinate is great enough such that oscillation of the ropes will cause the ropes to contact the wall adjacent to the ropes and thereby limit the magnitude of the oscillation.

18 Claims, 3 Drawing Sheets fig. 1
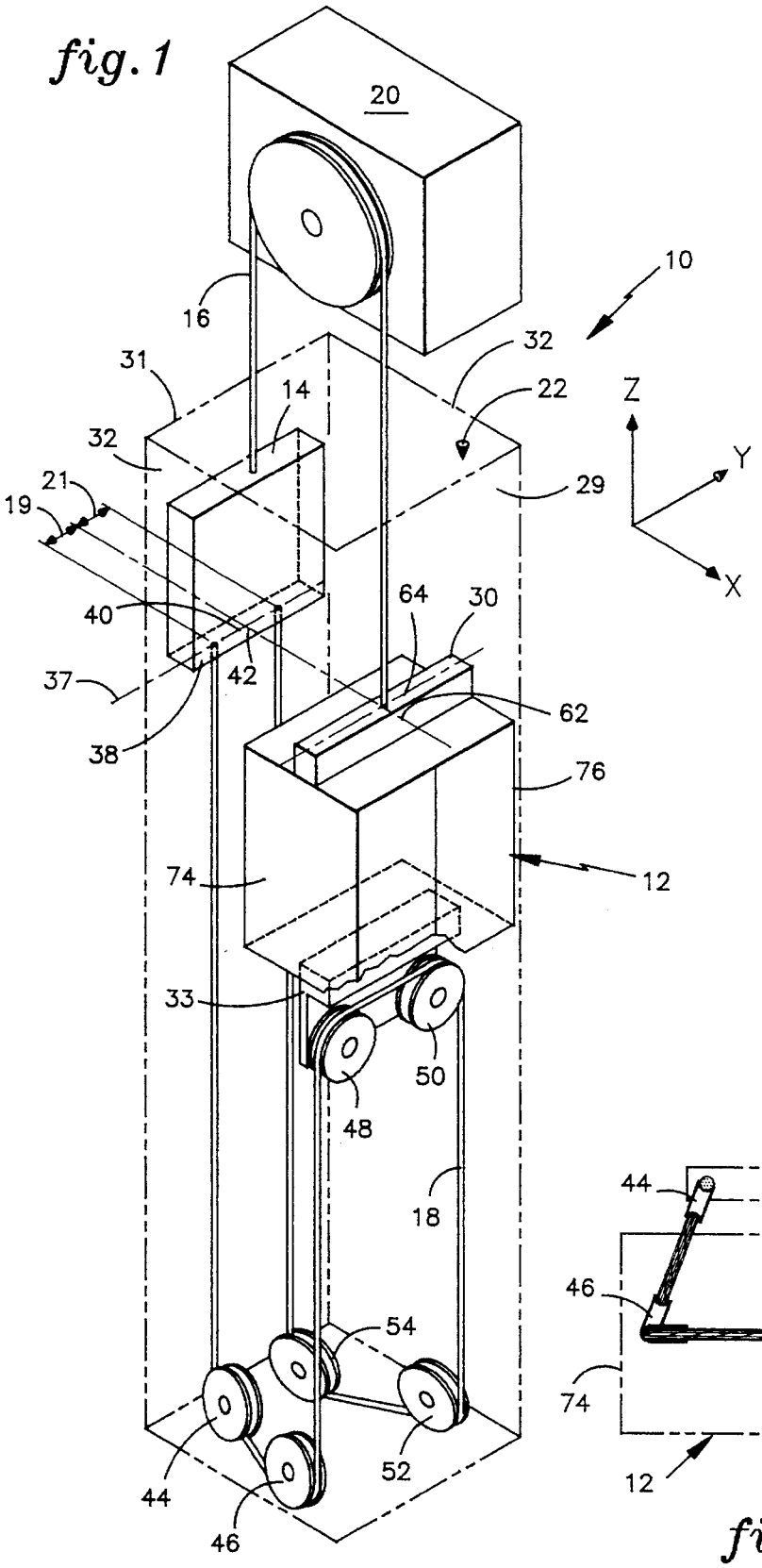
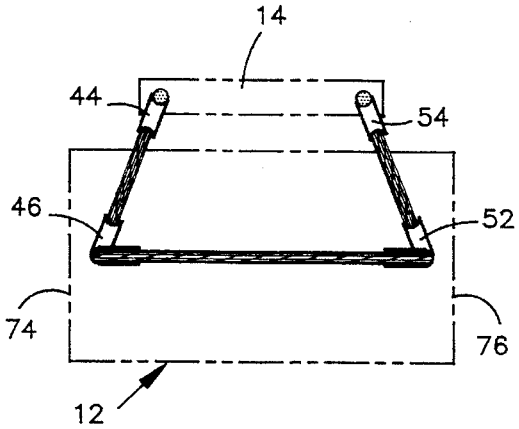
fig. 2

*fig.3*
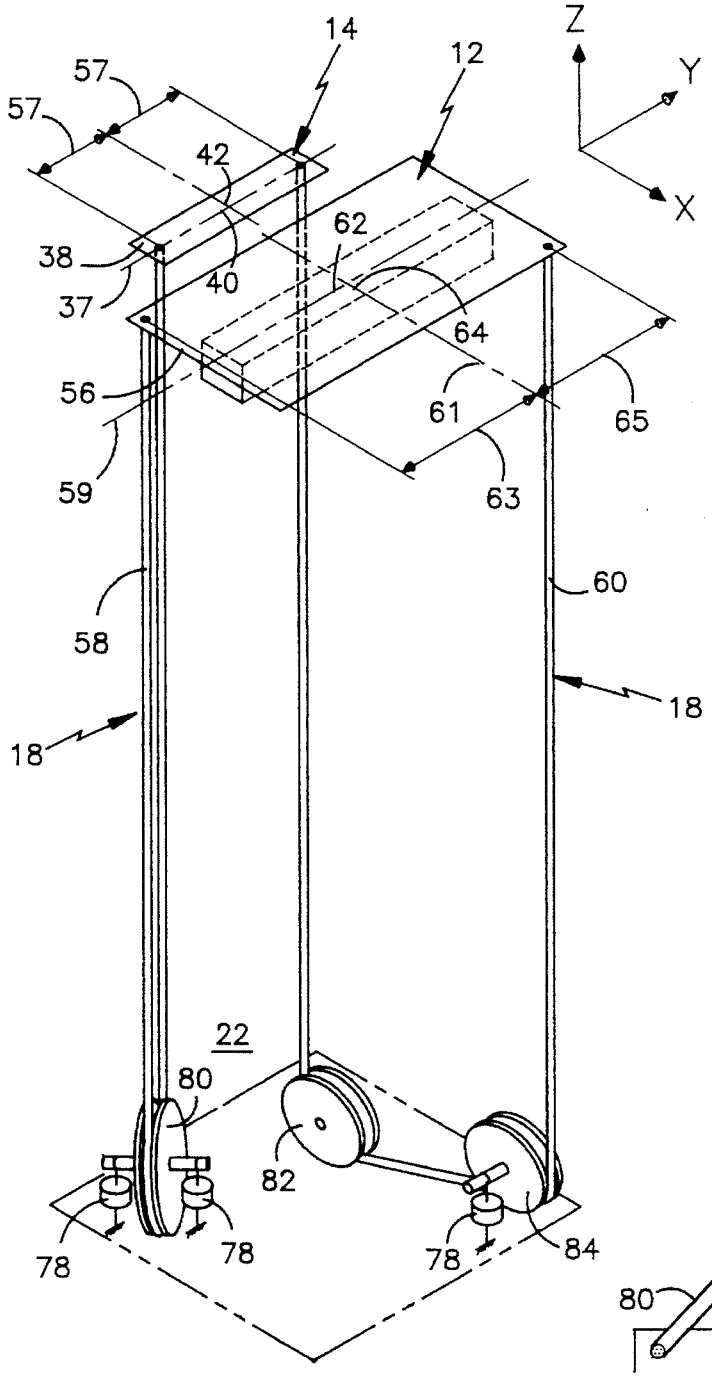
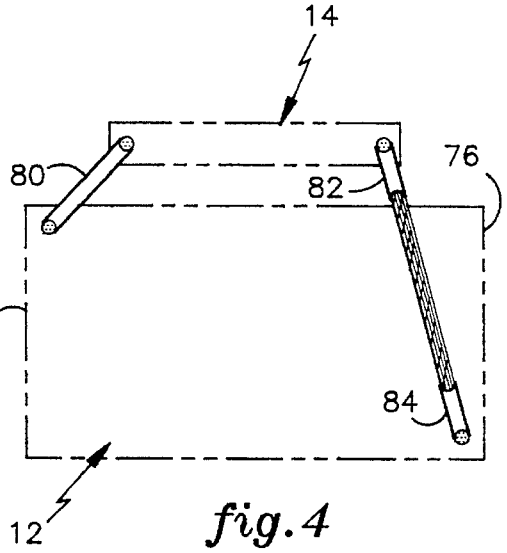
*fig.4*

METHOD FOR REDUCING ROPE SWAY IN ELEVATORS

BACKGROUND OF THE INVENTION

1. Technical Field

The present invention relates to methods for roping an elevator car and counterweight in a hoistway in general, and to methods for controlling sway of those ropes in particular.

2. Background Information

Roped elevators include a car and a counterweight confined to travel along guiderails in a vertically extending hoistway. The car and the counterweight are connected to one another by hoist ropes that extend from one of the car or the counterweight up the hoistway to a sheave located in a machine room at the top of the hoistway. The ropes wrap around the sheave and return back down and attach to the other of the car or counterweight. In conventional elevators, the sheave at the top of the elevator is powered by an electrical motor. In other elevators, the sheave at the top of the elevator is unpowered and the drive means is a linear motor mounted on the counterweight.

The hoist ropes connecting the car and the counterweight are typically steel cables having a hemp core for flexibility and lubrication purposes. Steel cable hoist ropes possess the strength and durability necessary in an elevator application. The strength and durability of steel hoist ropes is not without cost, however, as these ropes collectively contribute a significant percentage of the weight to be moved in an elevator. This is especially true in high rise buildings. Weight compensating ropes extending from the bottom of the car to the bottom of the counterweight can be used to offset the weight of the hoist ropes, and to thereby minimize the work to be done by the drive means. When a car is at the bottom of the hoistway, for example, the compensating ropes extend up the hoistway under the counterweight and offset the hoistway ropes extending from the machine room down the hoistway to the car. Conversely, when the car is at the top of the hoistway and the counterweight at the bottom of the hoistway, the compensating ropes extend up the hoistway under the car and offset the hoist ropes extending from the machine room down to the counterweight. Extending ropes a significant distance within the hoistway poses other problems besides weight compensation, however.

Rope sway can be a significant problem in a roped elevator. Rope sway refers to oscillation of the hoist and/or compensation ropes within the hoistway. Oscillation can be prompted, for example, by vibration emanating from wind induced building deflection and/or the vibration of the ropes at work. If the frequency of these disturbing vibrations approaches or enters a natural harmonic of the ropes, the oscillation may begin to grow to displacements far greater than the disturbance displacement. When this happens, it is likely that the ropes will tangle on equipment within the hoistway or as the elevator runs, jump out of the grooves of their respective sheaves. If the ropes oscillate out of phase with one another, they may also become tangled with each other. In any case, the elevator may be subject to potentially serious damage.

DISCLOSURE OF INVENTION

It is, therefore, an object of the present invention to provide a method for minimizing rope sway in an elevator.

It is a further object of the present invention to increase the safety of an elevator by preventing damage due to rope sway.

It is a still further object of the present invention to eliminate damage within a hoistway resulting from rope sway.

It is a still further object of the present invention to minimize rope sway in a high rise elevator and thereby allow greater rise elevators to be developed.

According to the present invention a method for controlling rope sway in an elevator is provided. In the first step a car is provided for travel in a hoistway, wherein the hoistway includes a pair of opposed vertically extending walls between which the car travels. The car includes a center of gravity having an x coordinate and a y coordinate. In the second step, a counterweight is provided for traveling between the hoistway walls. The car and the counterweight are connected to one another by a plurality of ropes. In the third step, a first number of ropes are attached to the car a distance away from the x coordinate of the car. In the fourth step, a second number of ropes are attached to the car a distance away from the x coordinate, equal to the distance the first number of ropes are away from the x coordinate, on the opposite side of the x coordinate as the first number of ropes. The distance the ropes are attached away from the x coordinate is great enough such that oscillation of the ropes will cause the ropes to contact the side of the hoistway adjacent to the ropes and thereby limit the magnitude of the oscillation.

According to a further aspect of the present invention, an additional step is provided where the distance the ropes are away from the center of gravity and toward the walls is adjusted to an amount such that the walls prevent the magnitude of the rope oscillations from exceeding a predetermined value and thereby prevent the ropes from significantly interfering with each other.

An advantage of the present invention is that the safety of the elevator is increased by minimizing or eliminating damage due to rope sway.

A further advantage of the present invention is that damage within the hoistway resulting from rope sway is minimized or eliminated.

A still further advantage of the present invention is that rope sway can be minimized to an extent such that rope sway is no longer a limiting factor in the design of high rise elevators.

The foregoing features and advantages of the present invention will become more apparent in light of the following detailed description of the best mode for carrying out the invention and accompanying drawings.

BRIEF DESCRIPTION OF THE DRAWINGS

FIG. 1 is a diagrammatic view of an elevator.

FIG. 2 is a diagrammatic top view of the elevator shown in FIG. 1.

FIG. 3 is a diagrammatic view of one embodiment of the bottom of an elevator car and the bottom of a counterweight connected to one another by compensating ropes.

FIG. 4 is a diagrammatic top view of the elevator shown in FIG. 3.

BEST MODE FOR CARRYING OUT THE INVENTION

Figure 5:
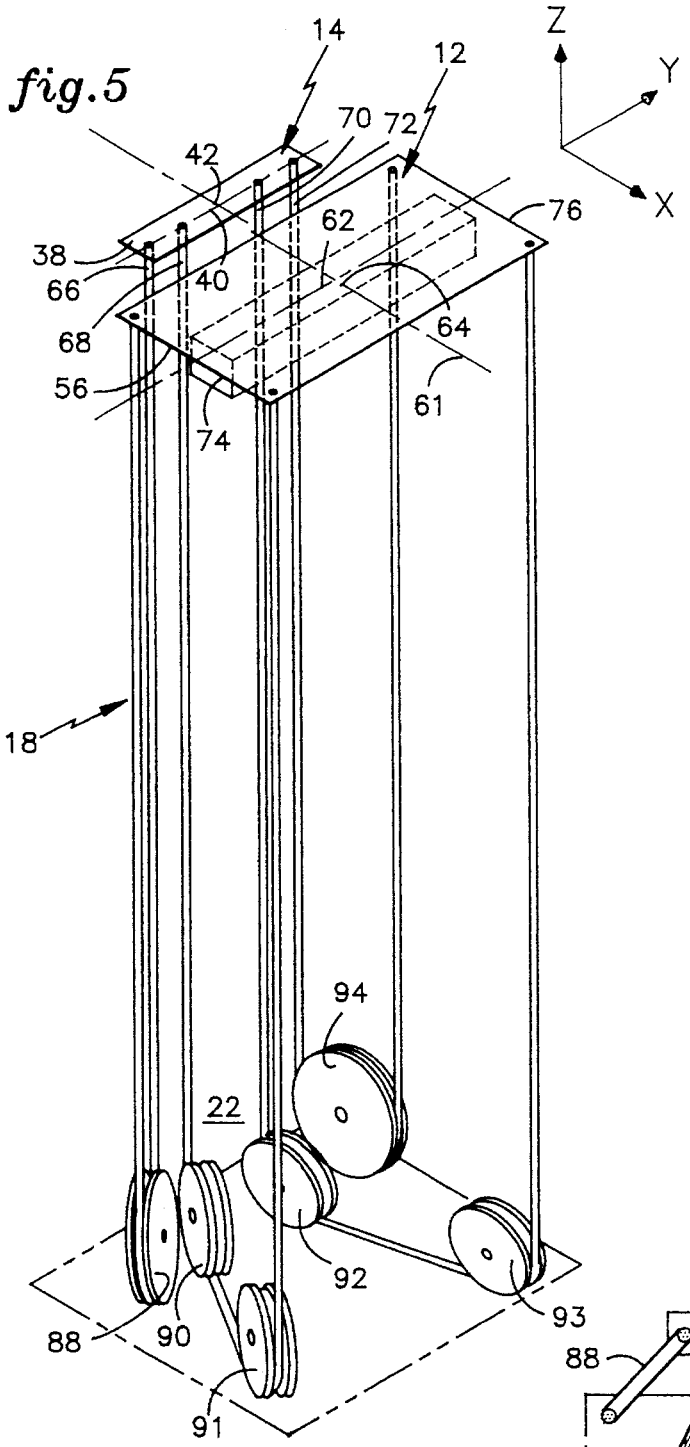
FIG. 5 is a diagrammatic view of another embodiment of the bottom of an elevator car and the bottom of a counterweight connected to one another by compensating ropes.

Referring to FIG. 1, an elevator 10 is shown comprising an elevator car 12 and a counterweight 14 attached to one another by hoist ropes 16 and compensating ropes 18. The car 12 includes a cross head and a safety plank 33 as is known in the art. A drive 20 for propelling the car 12 and the counterweight 14 through a hoistway 22 is located in the machine room (not shown) at the top of the hoistway 22. The hoistway 22 includes a front wall 29, a back wall 31, and a pair of side walls 32. A person of skill in the art will recognize that adjacent hoistways 22 may be separated by walls consisting of spreader beams (not shown).

The car 12 and counterweight 14 each may be described as having a center of gravity which is defined as a point at which the summations of the moments in the x, y, and z planes about that point equal zero. In other words, the car 12 or counterweight 14 could theoretically be supported at a point (x,y,z) and be perfectly balanced, because all of the moments surrounding this point cancel one another out. The hoist ropes 16 are attached to a crosshead 30 of the car 12 at a point where the x 62 and y 64 coordinates of the center of gravity of the car are projected. The hoist ropes 16 are similarly attached to the top of the counterweight 14 at a point where the x 42 and y 40 coordinates of the center of gravity of the counterweight 14 are projected.

In a first embodiment, the compensating ropes 18 attach to the bottom 38 of the counterweight 14 along a y-axis center line 37 passing through the projected x,y coordinates 42,40 of the counterweight 14, a distance 19 away from the projected x,y coordinates 42,40. From there, the compensating ropes 18 extend down the hoistway 22 and wrap around a first compensating rope sheave 44. The ropes 18 then extend to and wrap around a second compensating rope sheave 46 before extending up the hoistway 22 in the direction of the car 12. The ropes 18 wrap around a first 48 and a second 50 car sheave attached to the safety plank 33 of the car 12 before extending back down the hoistway 22. The ropes 18 then wrap around a third 52 and fourth 54 compensating sheave before extending back up the hoistway 22 in the direction of the counterweight 14. The compensating ropes 18 finally attach to the bottom 38 of the counterweight 14 along the y-axis center line 37 passing through the projected x,y coordinates 42,40 of the counterweight 14, a distance 21 away from the projected x,y coordinates 42,40 equal to the distance 19 separating the other ends of the ropes 18 from the projected x,y coordinates 42,40. FIG. 2 shows a diagrammatic top view of this arrangement to better illustrate the rope and sheave arrangement.

An advantage of directing the compensating ropes 18 in the manner described in the first embodiment is that the first 48 and second 50 car sheaves position the ropes 18 near the walls 32 of the hoistway 22, and therefore limit the magnitude of rope oscillation. Another advantage of the first embodiment is that only one set of ropes 18 is used. One set of ropes strung as described heretofore eliminates the possibility of some compensating ropes 18 being more taut than others.

As an alternative within the first embodiment, an independent rope or chain (not shown) may be wrapped around the first 48 and second 50 car sheaves and attached to two independent compensating ropes. The independent compensating ropes follow the same path into the hoistway pit and to the counterweight as is described in the first embodiment. In the event of a difference in the force presented by the compensating ropes across the first 48 and second 50 car sheaves, the rope/chain would travel enough to compensate and bring the forces back to equilibrium. The use of an independent rope/chain enables the use of smaller, lighter car sheaves than would be needed for ropes 18.

Referring to FIG. 3, in a second embodiment, a car bottom 56 and counterweight bottom 38 are shown diagrammatically to better illustrate the paths of the compensating ropes 18. The compensating ropes 18 are evenly divided, half 58 attached to one side of the counterweight 14 and half 60 attached to the other side of the counterweight 14. Here again, the compensating ropes 18 are attached to the counterweight 14 along the y-axis center line 37 passing through the projected x,y coordinates 42,40 of the center of gravity of the counterweight 14, each half 58,60 an equal distance 61 from the projected x,y coordinates 42,40.

One half 58 of the compensating ropes 18 extends from the counterweight 14 and wraps around a first 80 compensating sheave before extending back up the hoistway 22 in the direction of the car 12. The other half 60 of the compensating ropes 18 extends from the counterweight 14 and wraps around a second 82 and third 84 compensating sheave before extending back up the hoistway 22 in the direction of the car 12. The first half 58 of the compensating ropes 18 attaches to the car bottom 56 a distance 63 away from an x-axis centerline 61 passing through the projected x,y coordinates 62,64 of the center of gravity of the car 12 on one side of the y-axis centerline 59 passing through the projected x,y coordinates 62,64 of the car 12. The other half 60 of the compensating ropes 18 attaches to the car bottom 56 a distance 65 away from the x-axis centerline 61 passing through the projected x,y coordinates 62,64, equal to that of the first half 58, on the opposite side of the y-axis centerline 59. In other words, the halves 58, 60 are attached to the car bottom 56 diagonally across from one another, on opposite sides of the projected x,y 62,64 coordinates of the car 12. In generic Cartesian coordinates, the positions may be described as −x, −y and x,y. FIG. 4 shows a diagrammatic top view of this arrangement to better illustrate the rope and sheave arrangement.

Referring to FIG. 5, in a third embodiment one quarter 66 of the compensating ropes 18 extends from the counterweight 14 and wraps around a first 88 compensating sheave before extending back up the hoistway 22 in the direction of the car 12. A second quarter 68 of the compensating ropes 18 extends from the counterweight 14 and wraps around a second 90 and third 91 compensating sheave before extending back up the hoistway 22 in the direction of the car 12. A third quarter 70 of the compensating ropes 18 extends from the counterweight 14 and wraps around a fourth 92 and fifth 93 compensating sheave before extending back up the hoistway 22 in the direction of the car 12. The fourth quarter 72 of the compensating ropes 18 extends from the counterweight 14 and wraps around a sixth 94 compensating sheave before extending back up the hoistway 22 in the direction of the car 12.

Figure 6:
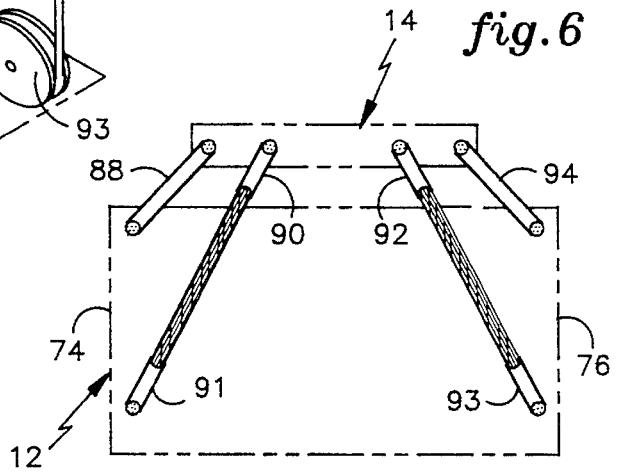
FIG. 6 is a diagrammatic top view of the elevator shown in FIG. 5.

The four quarters 66,68,70,72 of compensating ropes are attached to the bottom of the car in symmetrical positions relative to the projected x, y coordinates 62,64 of the center of gravity of the car 12 to balance their load on the car 12. In generic Cartesian coordinates, the four points may be described as: x,y, −x,y, x,−y, and −x,−y. The positions of the ropes 66,68,70,72 relative to the sides 74,76 of the car 12 are such that oscillation of the ropes will cause the ropes to contact the walls 32 of the hoistway (see FIG. 1). FIG. 6 shows a diagrammatic top view of this arrangement to better illustrate the rope and sheave arrangement.

Whether it is advantageous to use the compensating rope 18 arrangement described in embodiments 1, 2, or 3, depends upon the particular elevator application and what elements are attached within the hoistway 22 that must be avoided. Moreover, the exact position where the ropes 18 are attached relative to the projected x, y coordinates 62,64 of the car 12 may depend, in part, on what elements are attached within the hoistway 22 and must be avoided.

In all three embodiments, the compensating ropes 18 are attached symmetrically near the two sides 74, 76 of the car 12. The position of the ropes 18 relative to the car 12 puts them in close proximity to the side walls 32 (see FIG. 1) of the hoistway 22. In the event rope oscillation occurs, e.g., from wind induced building deflection and/or the vibration of the ropes at work, the sway of the ropes 18 will be limited by the hoistway walls 32. The limitation occurs because one of the major or minor axes of the rope oscillation, which naturally occur in an elliptical shape, will be limited by the distance between the rope 18 and the adjacent wall 32. Limiting one of the axes of the rope oscillation pattern will prevent the overall magnitude of the rope oscillation from growing to an undesirable magnitude where damage can occur in the hoistway 22.

Referring to FIG. 3, the compensating rope 18 embodiments described heretofore may include means 78 for dissipating vertical forces applied to the compensating sheaves by the compensating ropes 18 in the event the compensating ropes 18 pull the compensating sheaves vertically upward within the hoistway 22. As is known in the art, the means 78 for dissipating vertical forces may comprise a spring mount, a ratchet and pawl stroke limiter, or a fluid cylinder type shock absorber for one or more of the compensating sheaves. FIG. 3 diagrammatically shows a fluid cylinder type tie down shock absorbing device 78.

The best mode of the invention has been described heretofore in terms of the x and y coordinates of the center of gravity of the car and/or counterweight. A person of skill in the art will recognize that Cartesian coordinates represent one method of describing where the ropes are attached relative to the center of gravity of the car or counterweight. As an alternative, force vectors may be used to represent where and how much force the hoist and compensating ropes place on the car and/or counterweight relative to the center of gravity(s).

Although the invention has been shown and described with respect to a best mode embodiment thereof, it should be understood by those skilled in the art that various other changes, omissions and additions in the form and detail thereof may be made therein without departing from the spirit and scope of the claimed invention. For example, the roping embodiments have been described in terms of equal numbers of compensating rope off, erring one another. A person of skill in the art will recognize that different size and/or weight compensating ropes may be used to offset one another without disturbing the gravitational axis of symmetry of the car 12 and or counterweight 14. In that case, the numbers of compensating ropes 18 offsetting each other may not be equal. Furthermore, the examples given disclose using three or six compensating sheaves in the pit of the hoistway. A person of skill in the art will recognize that the number of sheaves may be altered by using different diameter sheaves.

I claim:

1. A method for controlling rope sway in an elevator, comprising the steps of:

providing a car for travel in a hoistway, said hoistway having a pair of opposed vertically extending walls, between which said car travels, wherein said car includes a bottom extending between said wails, and a center of gravity having an x and a y coordinate;

providing a counterweight for traveling between said hoistway walls, wherein said car and said counterweight are connected to one another by a plurality of ropes, extending therebetween;

attaching a first number of said ropes to said car a distance away from said x coordinate;

attaching a second number of said ropes to said car a distance away from said x coordinate, equal to said distance said first number of ropes are away from said x coordinate, on the opposite side of said x coordinate as said first number of ropes;

wherein said distance said ropes are attached away from said x coordinate is great enough such that oscillation of said ropes will cause said ropes to contact said wall adjacent to said ropes and thereby limit the motion of said oscillation.

2. A method for controlling rope sway in an elevator according to claim 1, wherein said second number of said ropes equals said first number of ropes.

3. A method for controlling rope sway in an elevator according to claim 2, wherein said ropes are weight compensating ropes extending from said car to at least one compensating sheave at the bottom of said hoistway and then to said counterweight.

4. A method for controlling rope sway in an elevator according to claim 3, further comprising the step of:

adjusting said distance of said ropes away from said center of gravity and toward said walls to an amount such that said walls limit the magnitude of said oscillations of said ropes and thereby prevent said ropes from significantly interfering with each other.

5. A method for controlling rope sway in an elevator according to claim 4, wherein said first number of ropes is attached to said car on one side of said y coordinate, and said second number of ropes is attached to said car on the opposite side of said y coordinate.

6. A method for controlling rope sway in an elevator according to claim 4, wherein one half of said first number of ropes is attached to said car on one side of said y coordinate and one half of said first number of ropes is attached to said car on the opposite side of said y coordinate; and wherein one half of said second number of ropes is attached to said car on one side of said y coordinate and one half of said second number of ropes is attached to said car on the opposite side of said y coordinate.

7. A method fix controlling rope sway in an elevator according to claim 6, where the positions of attachment of said first and second numbers of ropes are substantially symmetrical about the intersection of said x and y coordinates and therefore may be described in Cartesian coordinates generally as –x, –y, –x, y, x, –y, and x,y.

8. A method for controlling rope sway in an elevator according to claim 5, wherein said first number of ropes are attached to said car a distance away from said y coordinate and said second number of ropes are attached to said car a distance away from said y coordinate, wherein said distances said first and second number of ropes are away from said y coordinate are equal, and therefore the positions of attachment of said first and second number of ropes may be described in Cartesian coordinates generally as –x, –y and x,y.

9. A method for controlling rope sway in an elevator, comprising the steps of:

providing a car for travel in a hoistway, said hoistway having a pit and pair of opposed walls extending vertically upward from said pit, wherein said car includes:

a bottom;

a center of gravity having an x and a y coordinate; and a first and second sheave mounted on said bottom; providing a counterweight for traveling between said hoistway walls, wherein said car and said counterweight are connected to one another by a plurality of compensating ropes, said ropes having a first end and a second end;

providing a pair of compensating rope sheaves, fixed in said pit;

attaching said first end of said compensating ropes to said counterweight;

extending said ropes from said counterweight to and around one of said compensating rope sheave, then to and around said first sheave attached to said car, then to and around said second sheave attached to said car, then to and around the other of said compensating rope sheaves, then extending up to said counterweight;

attaching said second ends of said compensating ropes to said counterweight;

wherein said first sheave is attached to said bottom a distance away from said x coordinate of said car, and said second sheave is attached to said bottom a distance away from said x coordinate of said car, equal to said distance said first sheave is away from said x coordinate, on the opposite side of said x coordinate as said first sheave;

wherein said distance said sheaves are attached away from said x coordinate is great enough such that oscillation of said ropes will cause said ropes to contact said wall adjacent to said ropes and thereby dampen the motion of said oscillation.

10. A method for controlling rope sway in an elevator according to claim 9, further comprising the step of:

adjusting said distance of said first and second sheave away from said center of gravity and toward said walls to an amount such that said walls limit the magnitude of said oscillations of said ropes and thereby prevent said ropes from significantly interfering with each other.

11. An elevator, comprising:

a car, having a center of gravity having an x and a y coordinate;

a hoistway, having a pair of opposed vertically extending walls, between which said car travels, a counterweight, for traveling between said hoistway walls;

a plurality of ropes, extending between said car and said counterweight;

a drive, for powering said car and counterweight through said hoistway;

wherein a first number of said ropes is attached to said car a distance away from said x coordinate;

wherein a second number of said ropes are attached to said car a distance away from said x coordinate, equal to said distance said first number of ropes are away from said x coordinate, on the opposite side of said x coordinate as said first number of ropes; and wherein said distance said ropes are attached away from said x coordinate is great enough such that oscillation of said ropes will cause said ropes to contact said wall adjacent to said ropes and thereby limit the motion of said oscillation.

12. An elevator according to claim 11, wherein said second number of said ropes equals said first number of ropes.

13. An elevator according to claim 12, wherein said ropes are weight compensating ropes extending from said car to at least one compensating sheave at the bottom of said hoistway and then to said counterweight.

14. An elevator according to claim 13, wherein said distance of said ropes away from said center of gravity and toward said walls is such that said walls limit the magnitude of said oscillations of said ropes and thereby prevent said ropes from significantly interfering with each other.

15. An elevator according to claim 14, wherein said first number of ropes is attached to said car on one side of said y coordinate, and said second number of ropes is attached to said car on the opposite side of said y coordinate.

16. An elevator according to claim 14, wherein one half of said first number of ropes is attached to said car on one side of said y coordinate and one half of said first number of ropes is attached to said car on the opposite side of said y coordinate; and wherein one half of said second number of ropes is attached to said car on one side of said y coordinate and one half of said second number of ropes is attached to said car on the opposite side of said y coordinate.

17. An elevator according to claim 15, wherein said first ropes are attached to said car a distance away from said y coordinate and said second ropes are attached to said car a distance away from said y coordinate, wherein said distances said first and second number of ropes are away from said y coordinate are equal and therefore the positions of attachment of said first and second number of ropes may be described in Cartesian coordinates generally as –x,–y and x,y.

18. An elevator according to claim 16, where the positions of attachment of said first and second numbers of ropes are substantially symmetrical about the intersection of said x and y coordinates and therefore may be described in Cartesian coordinates generally as —x,—y, —x,y, x,—y, and x,y.

* * * * *